United States Patent [19]

Degner et al.

[11] Patent Number: 4,661,217

[45] Date of Patent: Apr. 28, 1987

[54] PREPARATION OF CARBAMIC ACID ESTERS

[75] Inventors: Dieter Degner, Dannstadt-Schauernheim; Heinz Hannebaum, Ludwigshafen; Michael Steiniger, Neustadt, all of Fed. Rep. of Germany

[73] Assignee: BASF Aktiengesellschaft, Ludwigshafen, Fed. Rep. of Germany

[21] Appl. No.: 895,173

[22] Filed: Aug. 11, 1986

[30] Foreign Application Priority Data

Aug. 17, 1985 [DE] Fed. Rep. of Germany ..... 3529531

[51] Int. Cl.[4] ..... C25B 3/02

[52] U.S. Cl. ..... 204/59 R; 204/72; 204/73 R; 560/24; 560/115

[58] Field of Search ..... 204/73 R, 59 R, 72

[56] References Cited

U.S. PATENT DOCUMENTS

| | | | |
|---|---|---|---|
| 3,459,643 | 8/1969 | Ross et al. | 204/59 R |
| 3,464,960 | 9/1969 | Sobieski et al. | 204/59 R |
| 3,941,666 | 2/1976 | Mitzlaff | 204/73 R |
| 4,036,712 | 7/1977 | Mitzlaff | 204/59 R |
| 4,140,593 | 2/1979 | Mitzlaff | 204/59 R |
| 4,288,300 | 9/1981 | Mitzlaff et al. | 204/59 R |
| 4,430,262 | 2/1984 | Engels et al. | 204/59 R |
| 4,457,813 | 7/1984 | Rogers et al. | 204/59 R |
| 4,510,024 | 4/1985 | Kishida et al. | 204/59 R |
| 4,588,482 | 5/1986 | Degner et al. | 204/59 R |
| 4,612,092 | 9/1986 | Degner et al. | 204/59 R |

OTHER PUBLICATIONS

Shono et al. J. Am. Chem. Soc., 97, (1975), pp. 4264–4268.

Ullmann, Enzyklopädie der techn. Chemie, 9, 118–119.

Houben—Weyl, Methoden d. org. Chemie, 8, 111–118.

L. Eberson and K. Nyberg, Tetrahedron 32, (1976), 2185–2206.

*Primary Examiner*—Arthur P. Demers

*Attorney, Agent, or Firm*—John H. Shurtleff

[57] ABSTRACT

Carbamic acid esters (I)

$$R^1NHCOOR^2 \quad (I)$$

wherein $R^1$ is H, alkyl, cycloalkyl or alkylaryl and $R^2$ is alkyl, are prepared by electro-oxidation of a formamide (II)

$$R^1NHCHO \quad (II)$$

in the presence of an alcohol $R^2OH$ and of an ionic halide.

4 Claims, No Drawings

PREPARATION OF CARBAMIC ACID ESTERS

The present invention relates to a novel process for the preparation of carbamic acid esters.

As is generally known, carbamic acid esters have hitherto been prepared from phosgene by reaction with an alcohol to give a chloroformic acid ester followed by aminolysis. In industrial operation, the handling of the highly toxic and corrosive starting materials and intermediates requires considerable effort. Further, the processes generate HCl or halogen-containing waste salts, which, in industrial operation, are often very expensive to remove (cf. Ullmann, Enzyklopte, uml/a/ die der techn. Chemie, 9, 118 et seq.).

In alternative processes which do not employ phosgene, urea is reacted with alkanols. The disadvantages here are high reaction temperatures, long reaction times, and the technical difficulty of handling solids (compare, eg. Houben-Weyl, Methoden d. org. Chemie, 8, 111 et seq.).

It is an object of the present invention to provide a process for the preparation of carbamic acid esters which is technically simple and economical and environmentally particularly unobjectionable.

We have found that this object is achieved and that carbamic acid esters of the general formula (I)

$$R^1NHCOOR^2 \quad (I),$$

where $R^1$ is hydrogen, alkyl, cycloalkyl or alkaryl and $R^2$ is low molecular weight alkyl, may be prepared particularly advantageously when a formamide of the general formula (II)

$$R^1NHCHO \quad (II)$$

is oxidized electrochemically in the presence of an alcohol of the formula $R^2OH$ and of an ionic halide.

The success of the process is surprising since it has long been known that the electrochemical reaction of formamides in alcohols in the presence of conductive salts such as tetraalkylammonium tetrafluoroborate always leads to alkoxyformamides (compare, eg. L. Eberson and K. Nyberg, Tetrahedron 32 (1976), 2185–2206), as is made clear by the following equation:

$$R-CH_2-NHCHO + R^2OH \xrightarrow[-2e,-2H^{\oplus}]{} R-\overset{OR^3}{CH}-NHCHO$$

The reaction according to the invention may be represented by the following equation:

$$\underset{(II)}{R^1NHCHO} + R^2OH \xrightarrow[-2e,-2H^{\oplus}]{} \underset{(I)}{R^1NHCOOR^2}$$

In the starting material of the formula (II), $R^1$ is hydrogen, alkyl, cycloalkyl or alkylaryl.

Preferred alkyl radicals are of 1 to 12, especially 1 to 8, more particularly 1 to 4, carbon atoms, eg. methyl, ethyl, n- and isopropyl, n-butyl and tert-butyl.

Preferred cycloalkyl radicals are of 3 to 8, especially 5 or 6, carbon atoms. $R^1$ may also be alkylaryl of 7 to 12, especially 7 or 8, carbon atoms, eg. benzyl or phenylethyl.

The radicals mentioned may additionally carry substituents which are inert under the reaction conditions, for example $C_1$–$C_4$-alkyl or $C_1$–$C_4$-alkoxy, halogen or nitrile.

The reaction may be carried out, for example, using the following formamides: methylformamide, ethylformamide, n- and isopropylformamide, n-butylformamide, n-octylformamide, cyclohexylformamide, cyclopentylformamide, benzylformamide and unsubstituted formamide.

In the alcohols of the formula $R^2OH$, $R^2$ is low molecular weight alkyl, especially alkyl of 1 to 5 carbon atoms, preferably methyl or ethyl. Examples of alcohols which may be used are n- and isopropanol, n-butanol, n-propanol and especially methanol and ethanol.

Suitable ionic halides are salts of hydriodic acid, hydrobromic acid and hydrochloric acid. Salts of hydrobromic acid, eg. alkali metal and alkaline earth metal bromides and quaternary ammonium bromides, especially tetraalkylammonium bromides, are particularly preferred. The cation is immaterial to the invention and it is therefore also possible to use other ionic metal halides, but the use of cheap halides is advantageous. Examples include sodium, potassium, calcium and ammonium bromides and dimethylammonium, trimethylammonium, tetramethylammonium and tetraethylammonium bromide.

The process according to the invention does not demand any particular electrolysis cell. It can advantageously be carried out in an unpartitioned continuous flow cell. The anode may consist of any conventional anode material which is stable under the electrolysis conditions, such as a noble metal, for example gold or platinum, or a metal oxide such as $NiO_x$. The preferred anode material is graphite. The cathode may for example consist of metals, such as lead, iron, steel, nickel or a noble metal, eg. platinum. The preferred cathode material is, again, graphite.

The composition of the electrolyte may be selected within wide limits. For example, it may consist of
10–80% by weight of $R^1NHCHO$,
10–80% by weight of $R^2OH$ and
0.1–10% by weight of halide.

If desired, a solvent may be added to the electrolyte, eg. to improve the solubility of the formamide or of the halide. Examples of such solvents are nitriles, eg. acetonitrile, carbonates, eg. dimethyl carbonate, and ethers, eg. tetrahydrofuran. The current density is not a limiting factor in the process according to the invention and is, eg., 1–25 A/dm$^2$, preferably 3–12 A/dm$^2$. If electrolysis is carried out under atmospheric pressure, the temperature is advantageously chosen to be at least 5°–10° C. below the boiling point of the electrolyte. If methanol or ethanol is used, the elecytolysis is preferably carried out at 20°–30° C. We have found, surprisingly, that the process according to the invention offers the possibility of high conversions of the formamides without deterioration in yield. The current yields are also exceptionally high in the process according to the invention. For example, complete conversion of the formamide is achieved when electrolyzing with only 2–2.5 F/mole of formamide.

The electrolysis products may be worked up by a conventional method. Advantageously, the electrolysis product is worked up by distillation. Excess alkanol and any co-solvent employed are first distilled off, the halides are removed in a conventional manner, for example by filtration or extraction, and the carbamic acid esters are purified by distillation or recrystallized. Alkanol, any unconverted formamide and co-solvent as well as halides can advantageously be recycled to the electrolysis. The process according to the invention may be carried out batchwise or continuously.

crystallized in a spectroscopically ($^1$H-NMR) pure form from the filtrate at 20°–30° C. The carbamates were obtained in yields of 57–88%, based on starting material (II), at 100% conversion.

Examples 1 to 9 are summarized in Table 1.

TABLE 1

Electro-oxidation of formamides (II) to carbamic acid esters (I)

$$\underset{(II)}{R^1NHCHO + R^2OH} \xrightarrow[-2e,\,-2H^{\oplus}]{} \underset{(I)}{R^1NHCOOR^2}$$

| Example | $R^1$ | $R^2$ | Starting material (II) [g] | Electrolyte II: NaBr:$R^2$OH [% by weight] | Number of electrodes | Amount of electricity [F/mole] | Current density [A/dm$^2$] | Yield [g] | Yield [%] |
|---|---|---|---|---|---|---|---|---|---|
| 1 | $CH_3$ | $CH_3$ | 390 | 15:1:84 | 6 | 2.5 | 3.3 | 477 | 81 |
| 2 | $CH_3$ | $CH_3$ | 390 | 15:2:83 | 6 | 2.5 | 6.7 | 519 | 88 |
| 3 | $CH_3$ | $C_2H_5$ | 390 | 15:1:84 | 6 | 2.5 | 3.3 | 481 | 71 |
| 4 | $C_2H_5$ | $CH_3$ | 375 | 15:1:84 | 11 | 2.8 | 3.3 | 414 | 78 |
| 5 | i-$C_3H_7$ | $CH_3$ | 300 | 10:1:89 | 6 | 2.25 | 3.3 | 314 | 78 |
| 6 | n-$C_8H_{17}$ | $CH_3$ | 300 | 15:1:84 | 6 | 2.25 | 3.3 | 285 | 80 |
| 7 | H | $CH_3$ | 260 | 15:1:84 | 9 | 2.5 | 3.3 | 247 | 57 |
| 8 | $C_6H_{11}$ | $CH_3$ | 603 | 16.4:0.7:82.9 | 9 | 2.1 | 3.3 | 620 | 82 |
| 9 | $CH_2C_6H_5$ | $CH_3$ | 300 | 15:1:84 | 6 | 2.2 | 3.3 | 286 | 78 |

The carbamic acid esters produced by the process according to the invention are versatile intermediates in the synthesis of isocyanates, crop protection agents and assistants, for example for textile finishing.

EXAMPLES

The electro-oxidation was carried out in an unpartitioned electrolysis cell with graphite anodes and cathodes, at 20°–25° C. During the electrolysis, the electrolyte, which contained sodium bromide as a conductive salt, was pumped through the cell via a heat exchanger at a rate of 200 liters/h. Table 1 shows the composition of the electrolyte.

After completion of the electrolysis, working up was effected by distilling off the alcohol under atmospheric pressure until the bottom temperature reached 120°–130° C. and purifying the residue by distillation at 5–40 mbar. In the case of unsubstituted methyl carbamate (Example 7), the product was purified by recrystallization from ethyl acetate. In Examples 8 and 9, the residue after removing the alcohol was filtered hot at 80°–100° C. to remove NaBr; thereafter the urethanes

We claim:

1. A process for the preparation of carbamic acid esters of the formula (I)

$$R^1NHCOOR^2 \qquad (I),$$

where $R^1$ is hydrogen, alkyl, cycloalkyl or alkaryl and $R^2$ is low molecular weight alkyl, wherein a formamide of the formula (II)

$$R^1NHCHO \qquad (II)$$

is oxidized electrochemically in the presence of an alcohol of the formula $R^2OH$ and of an ionic halide.

2. A process as claimed in claim 1, wherein the halide used is a salt of hydrobromic acid.

3. A process as claimed in claim 1, wherein graphite anodes are used for the electrolysis.

4. A process as claimed in claim 1, wherein the alcohol used is methanol or ethanol.

* * * * *